US009231378B2

(12) United States Patent
DeGuchi

(10) Patent No.: US 9,231,378 B2
(45) Date of Patent: Jan. 5, 2016

(54) SPARK PLUG FOR INTERNAL COMBUSTION ENGINE

(71) Applicant: DENSO CORPORATION, Kariya, Aichi-pref. (JP)

(72) Inventor: Masataka DeGuchi, Chiryu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/299,382

(22) Filed: Jun. 9, 2014

(65) Prior Publication Data

US 2014/0361677 A1 Dec. 11, 2014

(30) Foreign Application Priority Data

Jun. 10, 2013 (JP) ..... 2013-121718

(51) Int. Cl.

| | |
|---|---|
| ***H01T 13/20*** | (2006.01) |
| ***H01T 13/00*** | (2006.01) |
| ***F02P 15/00*** | (2006.01) |
| ***H01T 13/40*** | (2006.01) |

(52) U.S. Cl.

CPC ..... *H01T 13/20* (2013.01); *F02P 15/00* (2013.01); *H01T 13/40* (2013.01)

(58) Field of Classification Search

CPC ..... H01T 4/00; H01T 4/02; H01T 4/04; H01T 4/06; H01T 4/08; H01T 4/10; H01T 13/20

USPC ..... 313/141

See application file for complete search history.

(56) References Cited

U.S. PATENT DOCUMENTS

| | | | | |
|---|---|---|---|---|
| 4,004,562 | A | 1/1977 | Rado et al. | |
| 4,767,967 | A * | 8/1988 | Tanaka et al. | 315/55 |
| 5,044,349 | A * | 9/1991 | Benedikt et al. | 123/655 |
| 5,087,882 | A | 2/1992 | Iwata | |
| 6,060,821 | A | 5/2000 | Suzuki et al. | |
| 6,070,568 | A | 6/2000 | Dibble et al. | |
| 6,539,930 | B2 * | 4/2003 | Inagaki | 123/655 |
| 2011/0126789 | A1 | 6/2011 | Suwa et al. | |

(Continued)

FOREIGN PATENT DOCUMENTS

| | | |
|---|---|---|
| CN | 2179642 | 10/1994 |
| JP | 59-016088 | 1/1984 |

(Continued)

OTHER PUBLICATIONS

Machine English translation of JP61178561 to Goto et al.*

(Continued)

*Primary Examiner* — Sikha Roy

(74) *Attorney, Agent, or Firm* — Nixon & Vanderhye PC

(57) ABSTRACT

A spark plug for an internal combustion engine includes a center electrode, a tubular insulator, a tubular metal shell, a ground electrode and an overvoltage preventer. The insulator has the center electrode inserted and held therein. The metal shell has the insulator inserted and held therein such that a proximal part of the insulator is exposed from the metal shell. The ground electrode is joined to a distal end of the metal shell and faces the center electrode through a spark gap formed between the center and ground electrodes. The overvoltage preventer prevents a voltage higher than or equal to a threshold voltage from being applied across the spark gap. The overvoltage preventer is arranged in the proximal part of the insulator so as to be positioned outside the metal shell and farther than the metal shell from the spark gap.

9 Claims, 9 Drawing Sheets

(56) References Cited

U.S. PATENT DOCUMENTS

| | | | | |
|---|---|---|---|---|
| 2013/0199485 | A1* | 8/2013 | Shibata et al. | 123/146.5 R |
| 2013/0199510 | A1 | 8/2013 | Shibata et al. | |
| 2014/0123967 | A1 | 5/2014 | Shibata et al. | |

FOREIGN PATENT DOCUMENTS

| | | |
|---|---|---|
| JP | 6-80313 | 10/1994 |
| JP | 7-6854 | 1/1995 |
| JP | 11-166468 | 6/1999 |
| JP | 2014-077432 | 5/2014 |
| JP | 2014-111920 | 6/2014 |

OTHER PUBLICATIONS

Machine English translation of CN2179642 to Lin.*
Office Action (5 pages) dated Jan. 21, 2015, issued in corresponding GB Application No. 1410278.4.
Office Action (2 pages) dated Jul. 7, 2015, issued in corresponding Japanese Application No. 2013-121718 and English translation (1 page).

* cited by examiner

SPARK PLUG FOR INTERNAL COMBUSTION ENGINE

CROSS-REFERENCE TO RELATED APPLICATION

This application is based on and claims priority from Japanese Patent Application No. 2013-121718 filed on Jun. 10, 2013, the content of which is hereby incorporated by reference in its entirety into this application.

BACKGROUND

1. Technical Field

The present invention relates to spark plugs for internal combustion engines.

2. Description of the Related Art

Generally, a spark plug is employed as igniting means in an internal combustion engine of, for example, a motor vehicle. The spark plug includes a center electrode, a tubular insulator having the center electrode inserted and held therein, a tubular metal shell (or housing) having a distal part of the insulator inserted and held therein, and a ground electrode that is joined to a distal end of the metal shell and faces the center electrode through a spark gap formed between the center and ground electrodes.

In operation, a high voltage is applied by an ignition coil to the spark plug, thereby breaking down the electrical insulation of the spark gap to generate sparks between the center and ground electrodes.

Moreover, Japanese Patent Application Publication No. JPH0680313 discloses a spark plug which has a voltage-constant element embedded in the insulator. The voltage-constant element has a characteristic that its electrical resistance decreases when a voltage higher than or equal to a threshold voltage is applied to it. The voltage-constant element is implemented by an avalanche diode or a varistor. The voltage-constant element is located within the metal shell and electrically connected between the secondary side of the ignition coil and the metal shell in parallel with a spark-discharge path that includes the center electrode, the spark gap, and the ground electrode. Consequently, with the voltage-constant element, it is possible to prevent a voltage higher than or equal to the threshold voltage from being applied across the spark gap. As a result, it is possible to reduce variation in the discharge voltage of the spark plug.

However, the spark plug disclosed in the above patent document may involve the following problems.

In operation, a distal part of the spark plug, which is inserted in a combustion chamber of the engine, will be heated to a high temperature by the heat generated by combustion of the air-fuel mixture in the combustion chamber. Moreover, the metal shell is generally made of a metal material having a relatively high heat conductivity. Therefore, when the distal part of the spark plug is heated, the heat of the distal part will be transmitted to the entire metal shell, thereby heating the entire metal shell also to a high temperature. Accordingly, the voltage-constant element, which is located within the metal shell, may be subjected to a high temperature which exceeds the heatproof temperature of the voltage-constant element. Consequently, the threshold voltage of the voltage-constant element may be changed and, in the worst case, the voltage-constant element may be damaged and become unable to normally function. As a result, it may become impossible for the spark plug to generate stable sparks in the spark gap.

SUMMARY

According to exemplary embodiments, there is provided a spark plug for an internal combustion engine. The spark plug includes a center electrode, a tubular insulator, a tubular metal shell, a ground electrode and an overvoltage preventer. The insulator has the center electrode inserted and held therein. The metal shell has the insulator inserted and held therein such that a proximal part of the insulator is exposed from the metal shell. The ground electrode is joined to a distal end of the metal shell and faces the center electrode through a spark gap formed between the center and ground electrodes. The overvoltage preventer prevents a voltage higher than or equal to a threshold voltage from being applied across the spark gap. The overvoltage preventer is arranged in the proximal part of the insulator so as to be positioned outside the metal shell and farther than the metal shell from the spark gap.

With the above arrangement of the overvoltage preventer, it is possible to prevent the overvoltage preventer from being overheated during operation of the spark plug.

More specifically, a distal part of the spark plug, which includes the ground electrode and a discharge portion (or chip) of the center electrode, is to be placed inside a combustion chamber of the engine. Consequently, the distal part of the spark plug will be heated to a high temperature by the heat generated by combustion of the air-fuel mixture in the combustion chamber. Moreover, the metal shell is generally made of a metal material having a relatively high heat conductivity. Therefore, when the distal part of the spark plug is heated, the heat of the distal part will be transmitted to the entire metal shell, thereby heating the entire metal shell also to a high temperature.

On the other hand, the insulator is generally made of a ceramic material having a relatively low heat conductivity. Moreover, the proximal part of the insulator is exposed from the metal shell. Consequently, it will be difficult for heat to be transmitted from the distal part of the spark plug and the metal shell to the proximal part of the insulator. Thus, the temperature of the proximal part of the insulator will be kept lower than those of the distal part of the spark plug and the metal shell.

Accordingly, by arranging the overvoltage preventer in the proximal part of the insulator, it is possible to prevent the overvoltage preventer from being overheated during operation of the spark plug. Consequently, it is possible to prevent a fault condition of the overvoltage preventer from occurring due to overheating of the overvoltage preventer. As a result, it is possible to keep the overvoltage preventer functioning normally, thereby allowing the spark plug to generate stable sparks in the spark gap.

In a further implementation, the overvoltage preventer is made up of at least one voltage-constant element which is electrically connected in parallel with a spark-discharge path that includes the center electrode, the ground electrode and the spark gap formed between the center and ground electrodes.

The spark plug further includes a stem that is electrically connected with the center electrode. The stem has a main body inserted and held in the insulator and a terminal that is positioned on the proximal side of the main body and protrudes from a proximal end of the insulator. The at least one voltage-constant element is electrically connected with the stem by a first connecting terminal and with the meal shell by a second connecting terminal.

In one exemplary embodiment, the insulator has a groove formed in a radially outer surface of the insulator so as to extend in an axial direction of the insulator. The at least one voltage-constant element and the first and second connecting terminals are received in the groove of the insulator so as to be positioned radially inward of the radially outer surface of the insulator.

Further, the groove has an element-receiving part for receiving the at least one voltage-constant element, a first connecting terminal-receiving part for receiving the first connecting terminal and a second connecting terminal-receiving part for receiving the second connecting terminal. In this case, it is preferable that at least one of the first and second connecting terminal-receiving parts has a smaller cross-sectional area perpendicular to the axial direction of the insulator than the element-receiving part.

In another exemplary embodiment, the insulator has both a first hole and a second hole formed therein. The first hole extends in the axial direction of the insulator. The second hole extends so as to communicate with the first hole and open on the radially outer surface of the insulator at a position adjacent to the metal shell. The first connecting terminal, the at least one voltage-constant element and part of the second connecting terminal are received in the first hole. The remainder of the second connecting terminal is received in the second hole.

It is preferable that the thickness of the insulator between the second connecting terminal and the main body of the stem is set to be greater than or equal to 1 mm.

In yet another exemplary embodiment, the at least one voltage-constant element is arranged in the insulator such that the distance between the at least one voltage-constant element and the main body of the stem increases in the axial direction of the insulator toward the spark gap.

It is preferable that on a cross section of the second connecting terminal perpendicular to the axial direction of the insulator, the thickness of the second connecting terminal in a radial direction of the insulator is less than the width of the second connecting terminal in a direction perpendicular to the radial direction.

It is also preferable that a filler member, which has a higher heat conductivity than air, is filled in a space formed between the at least one voltage-constant element and the insulator.

In still another exemplary embodiment, the at least one voltage-constant element is configured to include a main body and a base plate that has the main body mounted thereon. The base plate is made of a metal material and arranged so as to abut the insulator.

Further, the insulator has a groove formed in the radially outer surface of the insulator so as to extend in the axial direction of the insulator. The groove has a bottom surface and a pair of side surfaces. The bottom surface is recessed radially inward from the radially outer surface of the insulator and extends perpendicular to a radial direction of the insulator. The side surfaces extend respectively from opposite circumferential ends of the bottom surface to the radially outer surface of the insulator. The at least one voltage-constant element is arranged on the bottom surface of the groove. Each of the side surfaces of the groove makes an interior angle in the range of 90 to 120° with the bottom surface.

BRIEF DESCRIPTION OF THE DRAWINGS

The present invention will be understood more fully from the detailed description given hereinafter and from the accompanying drawings of exemplary embodiments, which, however, should not be taken to limit the invention to the specific embodiments but are for the purpose of explanation and understanding only.

In the accompanying drawings.

DESCRIPTION OF EMBODIMENTS

Figure 1:
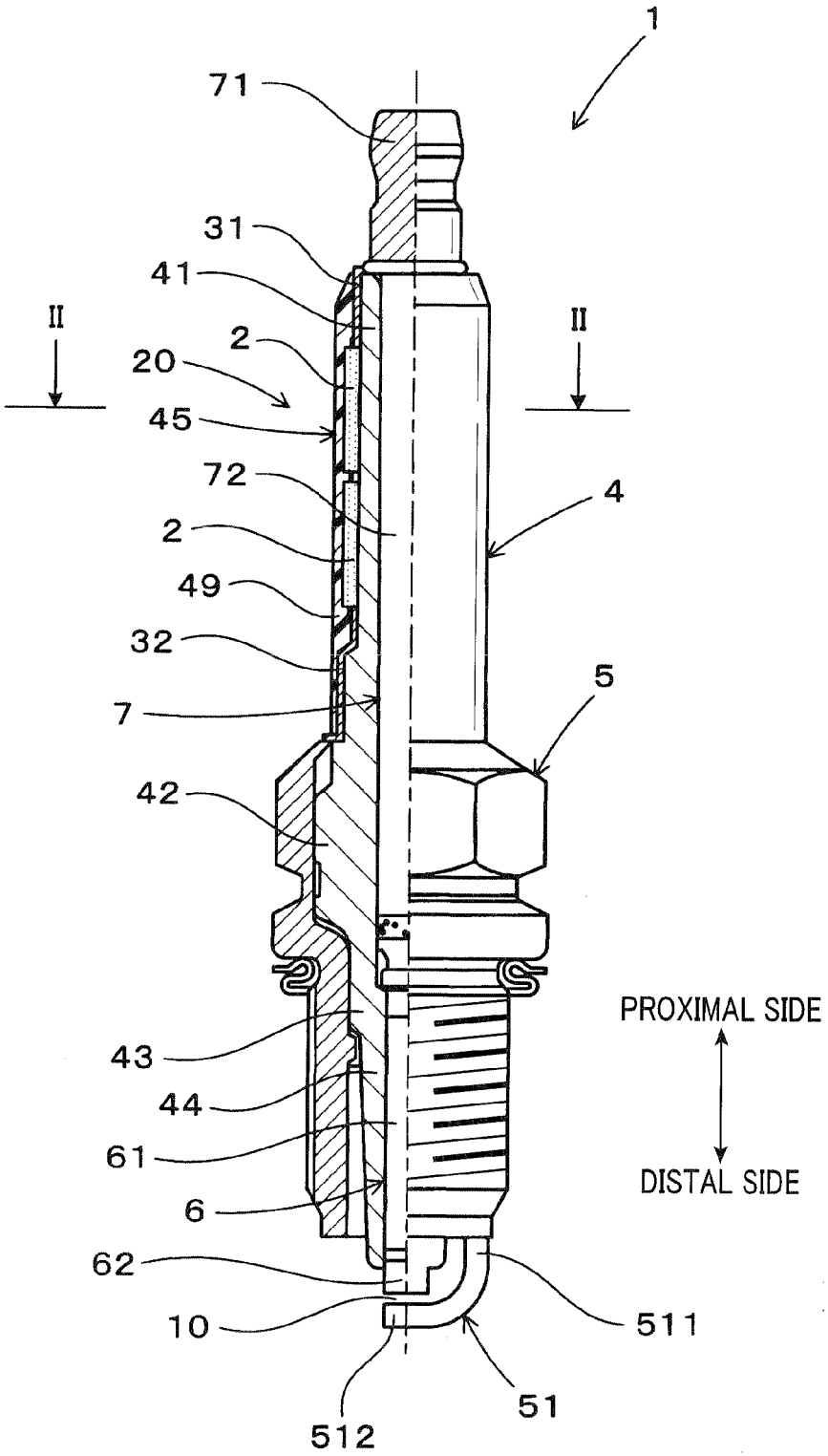
FIG. 1 is a partially cross-sectional view of a spark plug according to a first embodiment.

Exemplary embodiments will be described hereinafter with reference to FIGS. 1-11. It should be noted that for the sake of clarity and understanding, identical components having identical functions throughout the whole description have been marked, where possible, with the same reference numerals in each of the figures and that for the sake of avoiding redundancy, descriptions of the identical components will not be repeated.

[First Embodiment]

FIG. 1 shows the overall configuration of a spark plug 1 according to a first embodiment.

As shown in FIG. 1, the spark plug 1 includes a center electrode 6, a tubular insulator 4 having the center electrode 6 inserted and held therein, a tubular metal shell (or housing) 5 having the insulator 4 inserted and held therein, a ground electrode 51 that is joined to the metal shell 5 and faces the center electrode 6 through a spark gap 10 formed between the center and ground electrodes 6 and 51, and a stem 7 that is partially received in the insulator 4 and electrically connected with the center electrode 6.

Moreover, in the present embodiment, the spark plug 1 further includes an overvoltage preventer 20 for preventing a voltage higher than or equal to a threshold voltage from being applied across the spark gap 10. The overvoltage preventer 20 is arranged in the insulator 4 so as to be positioned outside the metal shell 5 and farther than the metal shell 5 from the spark gap 10.

Hereinafter, the configuration of the spark plug 1 according to the present embodiment will be described in more detail.

The spark plug 1 is designed to ignite the air-fuel mixture in a combustion chamber of an internal combustion engine of, for example, a motor vehicle. The spark plug 1 has one axial end to be connected to an ignition coil 8 (shown in FIG. 5) and the other axial end to be placed inside the combustion chamber (not shown). In addition, hereinafter, as shown in FIG. 1, the axial side where the spark plug 1 is to be connected to the ignition coil 8 will be referred to as "proximal side"; the other axial side where the spark plug 1 is to be placed inside the combustion chamber will be referred to as "distal side".

As shown in FIG. 1, the spark plug 1 includes the tubular insulator 4, the tubular metal shell 5 that retains the insulator 4 therein with a proximal part of the insulator 4 protruding outside of the metal shell 5, the center electrode 6 retained in the insulator 4 such that a distal end of the center electrode 6 axially protrudes outside of the insulator 4, and the substantially L-shaped ground electrode 51 joined to the distal end of the metal shell 5.

Specifically, in the present embodiment, the center electrode 6 includes a base member 61 and a discharge chip 62.

The base member 61 has a substantially cylindrical shape and is made of, for example, a nickel alloy.

The discharge chip 62 is joined, for example by welding, to a distal end of the base member 61. The discharge chip 62 is arranged so as to protrude from a distal end of the insulator 4. Moreover, the discharge chip 62 also has a substantially cylindrical shape with its diameter being equal to the diameter of the base member 61. The discharge chip 62 is made of a noble metal, such as iridium, platinum or rhodium, or a noble metal alloy. In addition, the discharge chip 62 may also be made of a non-noble metal having a high melting point, such as tungsten, ruthenium, tantalum or niobium, or an alloy of such a non-noble metal.

On the proximal side of the center electrode 6, there is arranged the stem 7 that includes a main body 72 and a terminal 71. The main body 72 is inserted and held in the insulator 4 and electrically connected with the center electrode 6. The terminal 71 is positioned on the proximal side of the main body 72 and protrudes from a proximal end of the insulator 4. In the present embodiment, the main body 72 and the terminal 71 are integrally formed into one piece. However, the main body 72 and the terminal 71 may also be formed separately and then assembled to each other.

The center electrode 6 and the main body 72 of the stem 7 are fixed to each other by a glass seal that is molten and solidified in the insulator 4. In addition, both the center electrode 6 and the main body 72 of the stem 7 are also fixed to the inner surface of the insulator 4 by the glass seal.

The metal shell 5 has a substantially hollow cylindrical shape. The metal shell 5 is arranged to cover the insulator 4 from about the axially center position of the insulator 4 distalward (i.e., toward the distal side) such that a distal end portion of the insulator 4 protrudes outside of the metal shell 5. Moreover, the metal shell 5 has a male threaded portion on an outer periphery thereof, so that the metal shell 5 can be fixed to a cylinder head (not shown) of the engine by fastening the male threaded portion into a female threaded bore of the cylinder head. The metal shell 5 is made of a metal material which is electrically conductive and has a relatively high heat conductivity, such as low-carbon steel.

The ground electrode 51 is bent at substantially a right angle to include a first portion 511 and a second portion 512. The first portion 511 extends from the distal end of the metal shell 5 distalward. The second portion 512 extends from a distal end of the first portion 511 radially inward to have an end part thereof axially facing the discharge chip 62 of the center electrode 6 through the spark gap 10 formed therebetween.

The insulator 4 is formed of alumina into a substantially hollow cylindrical shape. The insulator 4 includes a cylindrical portion 41, a large-diameter portion 42, a small-diameter portion 43 and a taper portion 44, which are sequentially positioned from the proximal side in this order.

More specifically, the cylindrical portion 41 is formed at the proximal end of the insulator 4. The large-diameter portion 42 adjoins the cylindrical portion 41 from the distal side and has a larger diameter than the cylindrical portion 41. The small-diameter portion 43 adjoins the large-diameter portion 42 from the distal side and has a smaller diameter than the large-diameter portion 42. The taper portion 44, which tapers distalward, adjoins the small-diameter portion 43 from the distal side.

In the present embodiment, the insulator 4 is inserted and held in the metal shell 5 such that almost the entire cylindrical portion 41 protrudes from the proximal end of the metal shell 5, whereas a distal part of the taper portion 44 protrudes from the distal end of the metal shell 5.

Moreover, as shown in FIGS. 1-4, in the radially outer surface of the cylindrical portion 41 of the insulator 4, there is formed a groove 45 that is recessed radially inward and extends in the axial direction of the cylindrical portion 41 (or the axial direction of the insulator 4). Further, the groove 45 includes an element-receiving part 47 for receiving a pair of voltage-constant elements 2 and a pair of connecting terminal-receiving parts 48 for respectively receiving a first connecting terminal 31 and a second connecting terminal 32. The pair of voltage-constant elements 2 makes up the overvoltage preventer 20. The first connecting terminal 31 electrically connects the pair of voltage-constant elements 2 to the terminal 71 of the stem 7. The second connecting terminal 32 electrically connects the pair of voltage-constant elements 2 to the metal shell 5. The connecting terminal-receiving parts 48 of the groove 45 are respectively formed on the proximal and distal sides of the element-receiving part 47.

Figure 2:
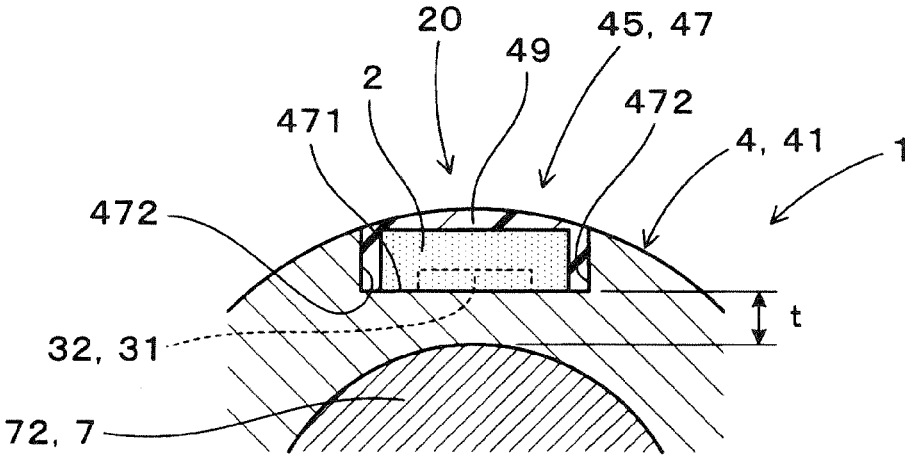
FIG. 2 is a cross-sectional view of part of the spark plug taken along the line II-II in FIG. 1.
Figure 3:
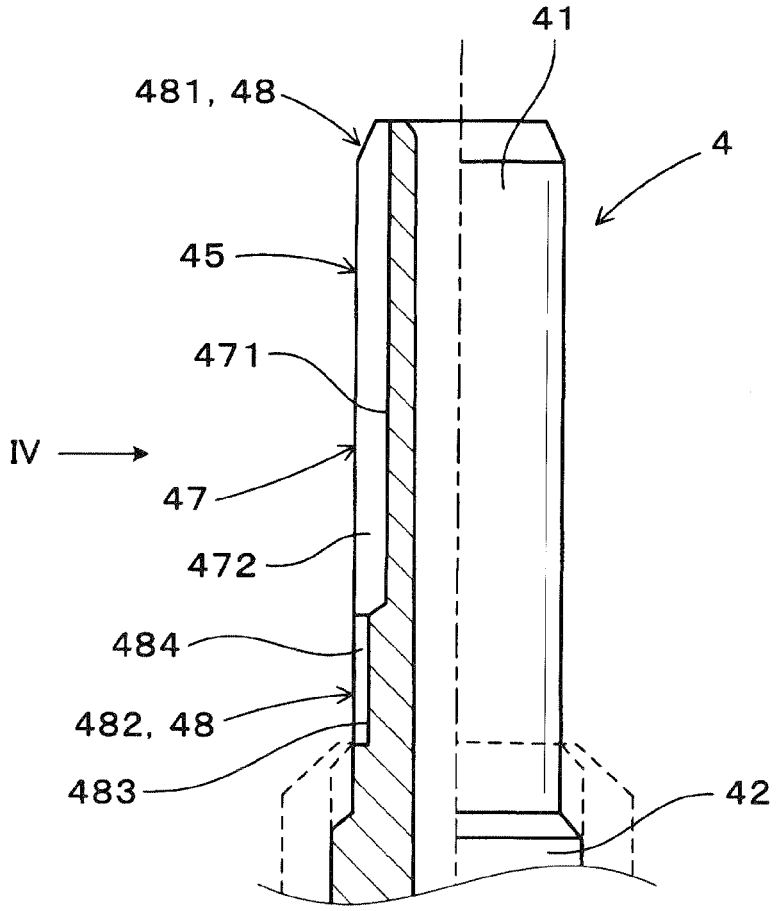
FIG. 3 is a partially cross-sectional view of part of an insulator of the spark plug according to the first embodiment.
Figure 4:
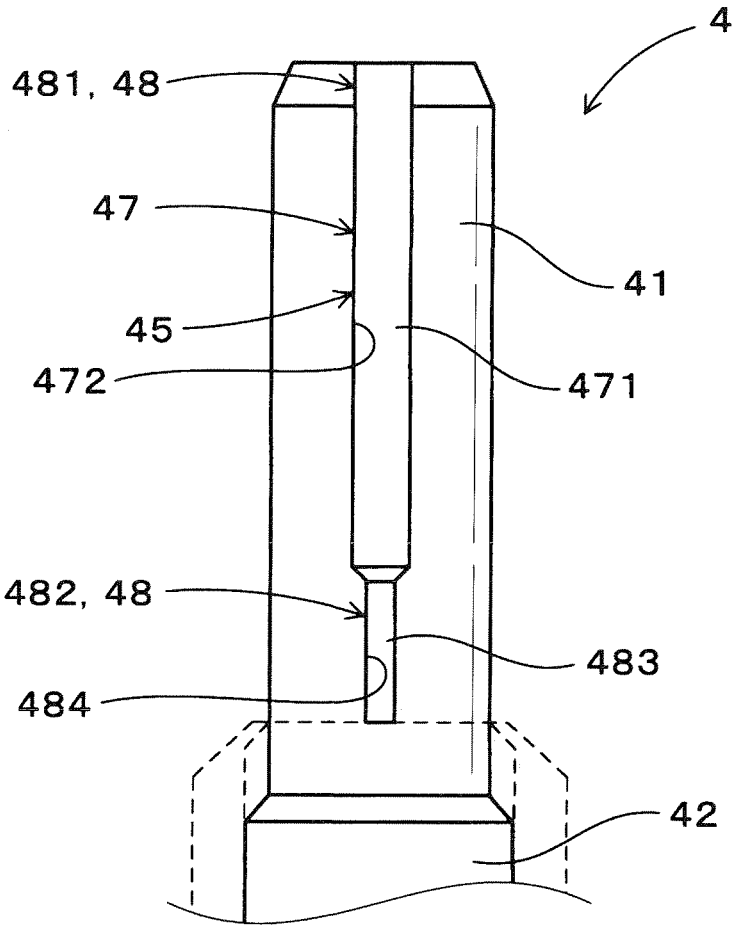
FIG. 4 is a side view of the part of the insulator along the IV direction in FIG. 3.

More specifically, as shown in FIGS. 2-4, the element-receiving part 47 of the groove 45 has a bottom surface 471 and a pair of side surfaces 472. The bottom surface 471 is recessed radially inward from the radially outer surface of the cylindrical portion 41 of the insulator 4 and extends perpendicular to a radial direction of the cylindrical portion 41 (or extends parallel to a plane perpendicular to a normal direction to the radially outer surface of the cylindrical portion 41). The side surfaces 472 extend respectively from opposite circumferential ends of the bottom surface 471 to the radially outer surface of the cylindrical portion 41.

In the present embodiment, both the side surfaces 472 extend perpendicular to the bottom surface 471. The height of the side surfaces 472 from the bottom surface 471 (or the length of the side surfaces 472 from the bottom surface 471 to the radially outer surface of the cylindrical portion 41 of the insulator 4) is set to be greater than the thickness of the voltage-constant elements 2. Moreover, the distance between the side surfaces 472 is set to be greater than the width of the voltage-constant elements 2.

In addition, in the present embodiment, the thickness t of the insulator 4 between the bottom surface 471 of the element-receiving part 47 of the groove 45 and the main body 72 of the stem 7 is set to be equal to 1 mm. Accordingly, in the present embodiment, the minimum thickness of the insulator 4 between the second connecting terminal 32 and the main body 72 of the stem 7 is equal to 1 mm.

As shown in FIGS. 3 and 4, the pair of connecting terminal-receiving parts 48 of the groove 45 consists of a first connecting terminal-receiving part 481 for receiving the first connecting terminal 31 and a second connecting terminal-receiving part 482 for receiving the second connecting terminal 32.

The second connecting terminal-receiving part 482 of the groove 45 has a bottom surface 483 and a pair of side surfaces 484. The bottom surface 483 is recessed radially inward from the radially outer surface of the cylindrical portion 41 of the insulator 4 and extends perpendicular to the radial direction of the cylindrical portion 41. The side surfaces 484 extend respectively from opposite circumferential ends of the bottom surface 483 to the radially outer surface of the cylindrical portion 41.

In the present embodiment, both the side surfaces 484 extend perpendicular to the bottom surface 483. The height of the side surfaces 484 from the bottom surface 483 (or the length of the side surfaces 484 from the bottom surface 483 to the radially outer surface of the cylindrical portion 41 of the insulator 4) is set to be greater than the thickness of the second connecting terminal 32. Moreover, the distance between the side surfaces 484 is set to be greater than the width of the second connecting terminal 32.

In addition, in the present embodiment, the second connecting terminal-receiving part 482 has a smaller cross-sectional area perpendicular to the axial direction of the cylindrical portion 41 than the element-receiving part 47 of the groove 45. In other words, the area of a cross section of the second connecting terminal-receiving part 482 perpendicular to the axial direction is smaller than the area of a cross section of the element-receiving part 47 perpendicular to the axial direction.

On the other hand, the first connecting terminal-receiving part 481 of the groove 45 is formed by extending the element-receiving part 47 of the groove 45 proximalward (i.e., toward the proximal side) and thus has the same cross-sectional shape as the element-receiving part 47.

Referring back to FIGS. 1 and 2, in the present embodiment, the overvoltage preventer 20 is made up of the pair of voltage-constant elements 2 which is received in the element-receiving part 47 of the groove 45 of the insulator 4.

More specifically, in the present embodiment, each of the voltage-constant elements 2 is implemented by a Zener diode. The voltage-constant elements 2 are serially connected with each other and each have the shape of a rectangular prism. Both the voltage-constant elements 2 are arranged on the bottom surface 471 of the element-receiving part 47 of the groove 45 formed in the cylindrical portion 41 of the insulator 4 with their longitudinal directions coinciding with the axial direction of the cylindrical portion 41. In addition, the width of the voltage-constant elements 2 in a width direction of the element-receiving part 47 of the groove 45 is set to be greater than the thickness of the voltage-constant elements 2 in a depth direction of the element-receiving part 47. Here, the width direction of the element-receiving part 47 is perpendicular to both a normal direction to the bottom surface 471 of the element-receiving part 47 and the axial direction of the cylindrical portion 41, and the depth direction of the element-receiving part 47 coincides with the normal direction to the bottom surface 471.

Moreover, in the present embodiment, each of the voltage-constant elements 2 is oriented to have its anode facing proximalward and its cathode facing distalward. Further, the anode of one of the two voltage-constant elements 2 which is located on the distal side is electrically connected to the cathode of the other voltage-constant element 2 which is located on the proximal side.

Furthermore, as shown in FIG. 1, to the anode of the proximal-side voltage-constant element 2, there is electrically connected the first connecting terminal 31. On the other hand, to the cathode of the distal-side voltage-constant element 2, there is electrically connected the second connecting terminal 32.

The first connecting terminal 31 has a rectangular cross section perpendicular to the axial direction of the cylindrical portion 41 of the insulator 4 and arranged in the first connecting terminal-receiving part 481 of the groove 35 with the longitudinal direction of the cross section coinciding with a width direction of the first connecting terminal-receiving part 481. Here, the width direction of the first connecting terminal-receiving part 481 denotes a direction which is perpendicular to both a normal direction to the bottom surface of the first connecting terminal-receiving part 481 and the axial direction of the cylindrical portion 41 of the insulator 4. In addition, the normal direction to the bottom surface of the first connecting terminal-receiving part 481 represents a depth direction of the first connecting terminal-receiving part 481.

Similarly, the second connecting terminal 32 has a rectangular cross section perpendicular to the axial direction of the cylindrical portion 41 of the insulator 4 and arranged in the second connecting terminal-receiving part 482 of the groove 35 with the longitudinal direction of the cross section coinciding with a width direction of the second connecting terminal-receiving part 482. Here, the width direction of the second connecting terminal-receiving part 482 denotes a direction which is perpendicular to both a normal direction to the bottom surface 483 of the second connecting terminal-receiving part 482 and the axial direction of the cylindrical portion 41 of the insulator 4. In addition, the normal direction to the bottom surface 483 of the second connecting terminal-receiving part 482 represents a depth direction of the second connecting terminal-receiving part 482.

As shown in FIG. 1, the first connecting terminal 31 extends from the proximal-side voltage-constant element 2 proximalward along the bottom surface of the first connecting terminal-receiving part 481 of the groove 45 so as to electrically connect the proximal-side voltage-constant element 2 to the terminal 71 of the stem 7. More specifically, in the present embodiment, a proximal end portion of the first connecting terminal 31 is joined by spot welding to the terminal 71 of the stem 7. In addition, it should be appreciated that the proximal end portion of the first connecting terminal 31 may also be joined to the main body 72 of the stem 7 instead of the terminal 71.

The second connecting terminal 32 extends from the distal-side voltage-constant element 2 distalward along a distal part of the bottom surface 471 of the element-receiving part 47 of the groove 45 and the bottom surface 483 of the second connecting terminal-receiving part 482 of the groove 45 so as to electrically connect the distal-side voltage-constant element 2 to the metal shell 5. More specifically, in the present embodiment, a distal end portion of the second connecting terminal 32 is joined by spot welding to the metal shell 5.

Moreover, as shown in FIGS. 1 and 2, a heat-conductive filler member 49 is filled in the groove 45 so as to embed the voltage-constant elements 2 and the first and second connecting terminals 31 and 32 in the groove 45. In the present embodiment, the filler member 49 is made of a resin having a high heat conductivity of, for example, about 1.0 W/mK. The filler member 49 is provided in the groove 45 so as to have its outer surface conformed to the radially outer surface of the cylindrical portion 41 of the insulator 4.

In the present embodiment, the filler member 49 is made of the resin having the high heat conductivity. However, the filler member 49 may also be made of other materials which have a higher heat conductivity than air.

More specifically, it is preferable that the filler member 49 is made of a material (e.g., a resin, glass or ceramic) having a heat conductivity higher than or equal to 0.2 W/mK. In this case, it is possible to effectively dissipate heat generated by the voltage-constant elements 2 via the filler member 49.

It is more preferable that the filler member 49 is made of a material having a heat conductivity in the range of 0.3 to 50 W/mK. In this case, it is possible to secure high formability and availability of the material.

Figure 5:
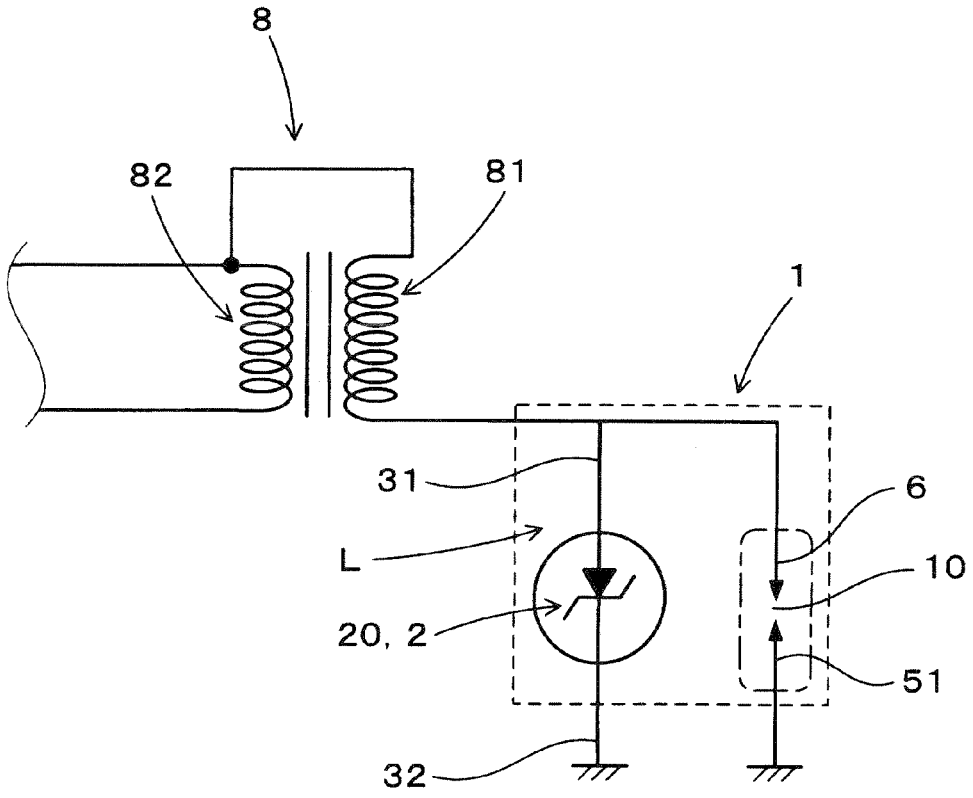
FIG. 5 is an equivalent circuit diagram of the spark plug according to the first embodiment.

Referring now to FIG. 5, in the spark plug 1 according to the present embodiment, the voltage-constant elements 2 and the first and second connecting terminals 31 and 32 are electrically connected to form a voltage-constant path L. Further, the voltage-constant path L is electrically connected in parallel with a spark-discharge path that includes the center electrode 6, the ground electrode 51 and the spark gap 10 formed between the center and ground electrodes 6 and 51. In addition, it should be noted that for the sake of simplicity, only one of the voltage-constant elements 2 is depicted in FIG. 5.

Moreover, the spark plug 1 is used in combination with the ignition coil 8. As shown in FIG. 5, the ignition coil 8 is comprised of a primary coil 82 and a secondary coil 81. Both the spark-discharge path and the voltage-constant path L formed in the spark plug 1 are electrically connected between the secondary coil 81 and the metal shell 5 that is grounded.

In operation, with voltage change in the primary coil 82, a high voltage is induced in the secondary coil 81. The high voltage is then applied across the spark gap 10 in the spark-discharge path, thereby generating sparks between the center and ground electrodes 6 and 51.

At the same time, the high voltage is also applied to the voltage-constant elements 2 in the voltage-constant path L. When the voltage applied to the voltage-constant elements 2 (i.e., the high voltage induced in the secondary coil 82) is lower than a breakdown voltage of the voltage-constant elements 2 (i.e., the threshold voltage of the overvoltage preventer 20), almost no electric current flows through the voltage-constant path L. In contrast, when the voltage applied to the voltage-constant elements 2 is higher than or equal to the breakdown voltage of the voltage-constant elements 2, in other words, when the voltage applied to the overvoltage preventer 20 is higher than or equal to the threshold voltage of the overvoltage preventer 20, electric current flows through the voltage-constant path L, thereby preventing an overvoltage (i.e., the high voltage induced in the second coil 82) from being applied across the spark gap 10.

After having described the configuration and operation of the spark plug 1 according to the present embodiment, advantages thereof will be described hereinafter.

In the present embodiment, the spark plug 1 includes the center electrode 6, the tubular insulator 4, the tubular metal shell 5, the ground electrode 51 and the overvoltage preventer 20. The insulator 4 has the center electrode 6 inserted and held therein. The metal shell 5 has the insulator 4 inserted and held therein such that the proximal part (i.e., the majority of the cylindrical portion 41) of the insulator 4 is exposed from the metal shell 5. The ground electrode 51 is joined to the distal end of the metal shell 5 and faces the center electrode 6 through the spark gap 10 formed between the center and ground electrodes 6 and 51. The overvoltage preventer 20 is configured to prevent a voltage higher than or equal to the threshold voltage from being applied across the spark gap 10. The overvoltage preventer 20 is arranged in the proximal part of the insulator 4 so as to be positioned outside the metal shell 5 and farther than the metal shell 5 from the spark gap 10.

With the above arrangement of the overvoltage preventer 20, it is possible to prevent the overvoltage preventer 20 from being overheated during operation of the spark plug 1.

More specifically, a distal part of the spark plug 1, which includes the ground electrode 51 and the discharge chip 62 of the center electrode 6, is to be placed inside the combustion chamber of the engine. Consequently, the distal part of the spark plug 1 will be heated to a high temperature by the heat generated by combustion of the air-fuel mixture in the combustion chamber. Moreover, the metal shell 5 is made of the metal material having the relatively high heat conductivity. Therefore, when the distal part of the spark plug 1 is heated, the heat of the distal part will be transmitted to the entire metal shell 5, thereby heating the entire metal shell 5 also to a high temperature.

On the other hand, the insulator 4 is made of alumina. In other words, the insulator 4 is made of a material having a relatively low heat conductivity. Moreover, the proximal part of the insulator 4 is exposed from the metal shell 5. Consequently, it will be difficult for heat to be transmitted from the distal part of the spark plug 1 and the metal shell 5 to the proximal part of the insulator 4. Thus, the temperature of the proximal part of the insulator 4 will be kept lower than those of the distal part of the spark plug 1 and the metal shell 5.

Accordingly, by arranging the overvoltage preventer 20 in the proximal part of the insulator 4, it is possible to prevent the overvoltage preventer 20 from being overheated during operation of the spark plug 1. Consequently, it is possible to prevent a fault condition of the overvoltage preventer 20 from occurring due to overheating of the overvoltage preventer 20. As a result, it is possible to keep the overvoltage preventer 20 functioning normally, thereby allowing the spark plug 1 to generate stable sparks in the spark gap 10.

Moreover, in the present embodiment, the overvoltage preventer 20 is made up of the pair of voltage-constant elements which is electrically connected in parallel with the spark-discharge path that includes the center electrode 6, the ground electrode 51 and the spark gap 10 formed between the center and ground electrodes 6 and 51.

Consequently, with the pair of voltage-constant elements 2, it becomes possible to easily and simply make up the overvoltage preventer 20. In addition, in this case, by arranging the pair of voltage-constant elements 2 (i.e., the overvoltage preventer 20) as described above, it is possible to suppress change in the breakdown voltage of the voltage-constant elements 2 due to heat transmitted to the voltage-constant elements 2.

In the present embodiment, the spark plug 1 further includes the stem 7 that is electrically connected with the center electrode 6. The stem 7 has the main body 72 inserted and held in the insulator 4 and the terminal 71 that is positioned on the proximal side of the main body 72 and protrudes from the proximal end of the insulator 4. The pair of voltage-constant elements 2 is electrically connected with the terminal 71 of the stem 7 by the first connecting terminal 31 and with the meal shell 5 by the second connecting terminal 32.

With the above configuration, it is possible to easily and reliably form the voltage-constant path L in parallel with the spark-discharge path.

In the present embodiment, the insulator 4 has the groove 45 formed in the radially outer surface of the insulator 4 (more specifically, in the radially outer surface of the cylindrical portion 41 of the insulator 4) so as to extend in the axial direction of the insulator 4 (more specifically, in the axial direction of the cylindrical portion 41). The voltage-constant elements 2 and the first and second connecting terminals 31 and 32 are received in the groove 45 of the insulator 4 so as to be positioned radially inward of the radially outer surface of the insulator 4.

With the above configuration, in connecting the ignition coil 8 to the spark plug 1, it is possible to prevent the voltage-constant elements 2 and the first and second connecting terminals 31 and 32 from making contact with the ignition coil 8. Consequently, it is possible to easily and reliably fix the voltage-constant elements 2 and the first and second connecting terminals 31 and 32 to the insulator 4.

In addition, it should be appreciated that part of either or both of the first and second connecting terminals 31 and 32 may be located radially outward from the radially outer surface of the insulator 4 to the extent of not making contact with the ignition coil 8.

Further, in the present embodiment, the groove 45 of the insulator 4 has the element-receiving part 47 for receiving the pair of voltage-constant elements 2, the first connecting terminal-receiving part 481 for receiving the first connecting terminal 31 and the second connecting terminal-receiving part 482 for receiving the second connecting terminal 32. Moreover, the second connecting terminal-receiving part 482 has a smaller cross-sectional area perpendicular to the axial direction of the insulator 4 than the element-receiving part 47.

With the above configuration, it is possible to increase the thickness of the insulator 4 between the second connecting terminal 32 and the stem 7, thereby improving electrical insulation therebetween.

In addition, it should be appreciated that the first connecting terminal-receiving part 481 may be modified to also have a smaller cross-sectional area perpendicular to the axial direction of the insulator 4 than the element-receiving part 47.

In the present embodiment, the thickness of the insulator 4 between the second connecting terminal 32 and the main body 72 of the stem 7 is set to be greater than or equal to 1 mm.

In the spark plug 1, voltage stress is highest at the second connecting terminal 32 which electrically connects the pair of voltage-constant elements 2 to the metal shell 5 that is grounded. However, by setting the thickness of the insulator 4 as above, it is still possible to ensure electrical insulation between the second connecting terminal 32 and the stem 7.

Moreover, in the present embodiment, as shown with dashed lines in FIG. 2, on a cross section of the second connecting terminal 32 perpendicular to the axial direction of the insulator 4, the thickness of the second connecting terminal 32 in a radial direction of the insulator 4 is less than the width of the second connecting terminal 32 in a direction perpendicular to the radial direction.

With the above configuration, it is possible to reduce the thickness of the second connecting terminal 32, thereby securing a sufficient distance between the second connecting terminal 32 and the stem 7. Consequently, it is possible to secure a sufficient thickness of the insulator 4 between the second connecting terminal 32 and the stem 7, thereby reliably preventing puncture (or breakdown) of the insulator 4 from occurring between the second connecting terminal 32 and the stem 7.

In the present embodiment, the filler member 49 is filled in the space formed between the insulator 4 and the pair of voltage-constant elements 2 received in the element-receiving part 47 of the groove 45 of the insulator 4. The filler member 49 is made of the resin which has a higher heat conductivity than air.

Consequently, it is possible to effectively dissipate heat generated by the voltage-constant elements 2 via the filler member 49.

[Second Embodiment]

This embodiment illustrates a spark plug 1 which has almost the same structure as the spark plug 1 according to the first embodiment; accordingly, only the differences therebetween will be described hereinafter.

In the first embodiment, the insulator 4 has the groove 45 formed in the radially outer surface of the cylindrical portion 41 thereof for receiving the voltage-constant elements 2 and the first and second connecting terminals 31 and 32 (see FIGS. 1-4).

Figure 6:
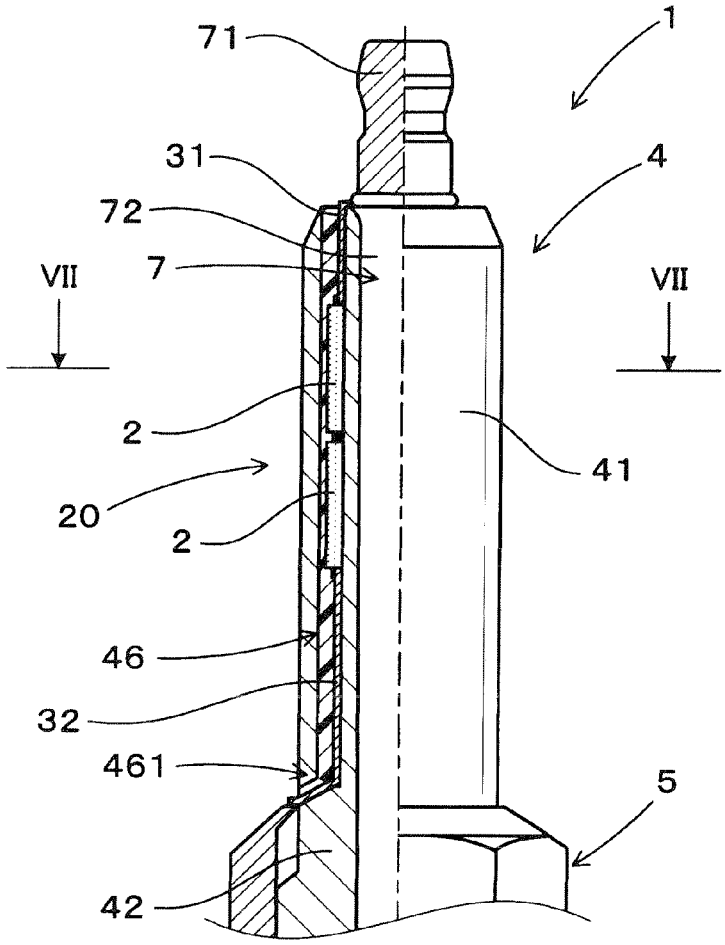
FIG. 6 is a partially cross-sectional view of part of a spark plug according to a second embodiment.
Figure 7:
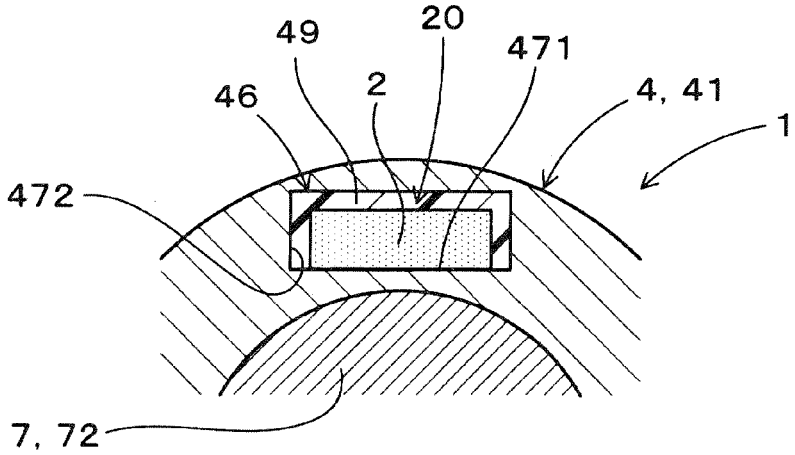
FIG. 7 is a cross-sectional view of part of the spark plug according to the second embodiment taken along the line VII-VII in FIG. 6.
Figure 8:
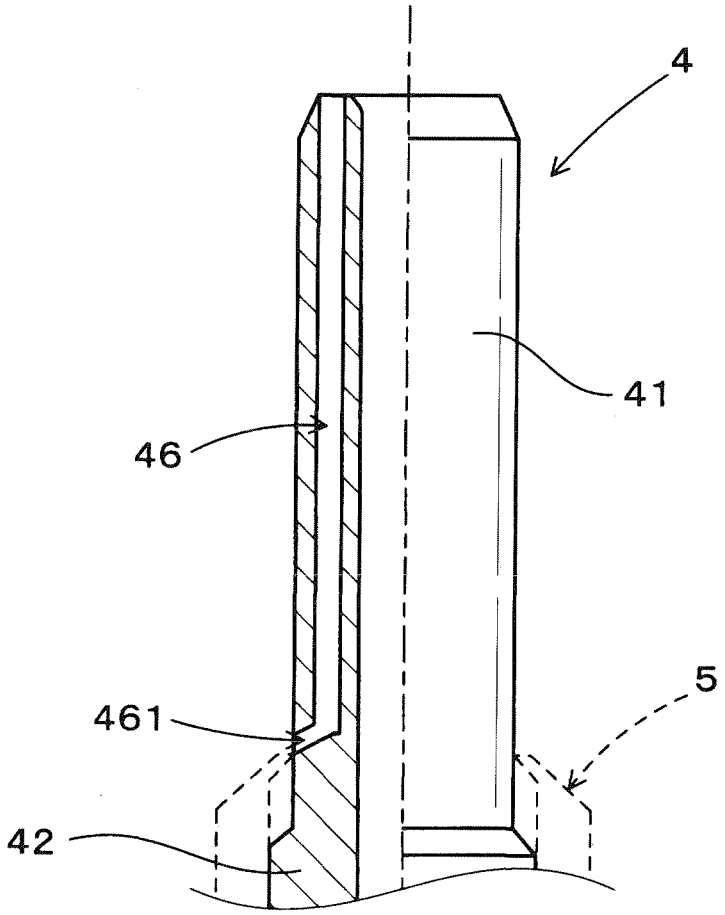
FIG. 8 is a partially cross-sectional view of part of an insulator of the spark plug according to the second embodiment.

In comparison, in the present embodiment, as shown in FIGS. 6-8, the insulator 4 has, instead of the groove 45, both a first hole 46 and a second hole 461 formed in the cylindrical portion 41 thereof. The first hole 46 extends in the axial direction of the cylindrical portion 41 (or the axial direction of the insulator 4) over almost the entire axial length of the cylindrical portion 41. The second hole 461 extends obliquely with respect to the axial direction of the cylindrical portion 41 so as to communicate with the first hole 46 and open on the radially outer surface of the cylindrical portion 41.

More specifically, the first hole 46 has a rectangular cross section perpendicular to the axial direction of the cylindrical portion 41; the longitudinal direction of the rectangular cross section is perpendicular to a radial direction of the cylindrical portion 41 (see FIG. 7). The first connecting terminal 31, the pair of voltage-constant elements 2 and the majority of the second connecting terminal 32 are received in the first hole 46 so as to abut the radially-innermost wall surface of the first hole 46.

On the other hand, the remainder of the second connecting terminal 32 is received in the second hole 461 that extends from the distal end of the first hole 46 to a position on the radially outer surface of the cylindrical portion 41 which is adjacent to the proximal end of the metal shell 5. Consequently, the second connecting terminal 32 can be electrically connected to the distal end of the metal shell 5.

Moreover, in the present embodiment, as shown in FIGS. 6 and 7, the heat-conductive filler member 49 is filled in the first and second holes 46 and 461 so as to occupy all the void spaces formed therein. Consequently, with the filler member 49, the voltage-constant elements 2 and the first and second connecting terminals 31 and 32 are fixed in the first and second holes 46 and 461.

The above-described spark plug 1 according to the present embodiment has almost the same advantages as the spark plug 1 according to the first embodiment.

In addition, in the present embodiment, the first connecting terminal 31, the pair of voltage-constant elements 2 and the majority of the second connecting terminal 32 are received in the first hole 46 that extends in the axial direction of the insulator 4. The remainder of the second connecting terminal 32 is received in the second hole 461 that communicates with the first hole 46 and opens on the radially outer surface of the cylindrical portion 41 of the insulator 4 at the position adjacent to the proximal end of the metal shell 5.

With the above configuration, it is possible to easily and reliably fix the pair of voltage-constant elements 2 and the first and second connecting terminals 31 and 32 in the insulator 4. Moreover, it is also possible to minimize the range of processing the radially outer surface of the cylindrical portion 41 of the insulator 4. Consequently, it is possible to keep the radially outer surface of the cylindrical portion 41 smooth and regular in shape.

[Third Embodiment]

This embodiment illustrates a spark plug 1 which has almost the same structure as the spark plug 1 according to the first embodiment; accordingly, only the differences therebetween will be described hereinafter.

In the first embodiment, the groove 45 is formed in the radially outer surface of the cylindrical portion 41 of the insulator 4 so that all the bottom surfaces of the element-receiving part 47 and the first and second connecting terminal-receiving parts 481 and 482 of the groove 45 extend in the axial direction of the cylindrical portion 41 (see FIGS. 1 and 3).

Figure 9:
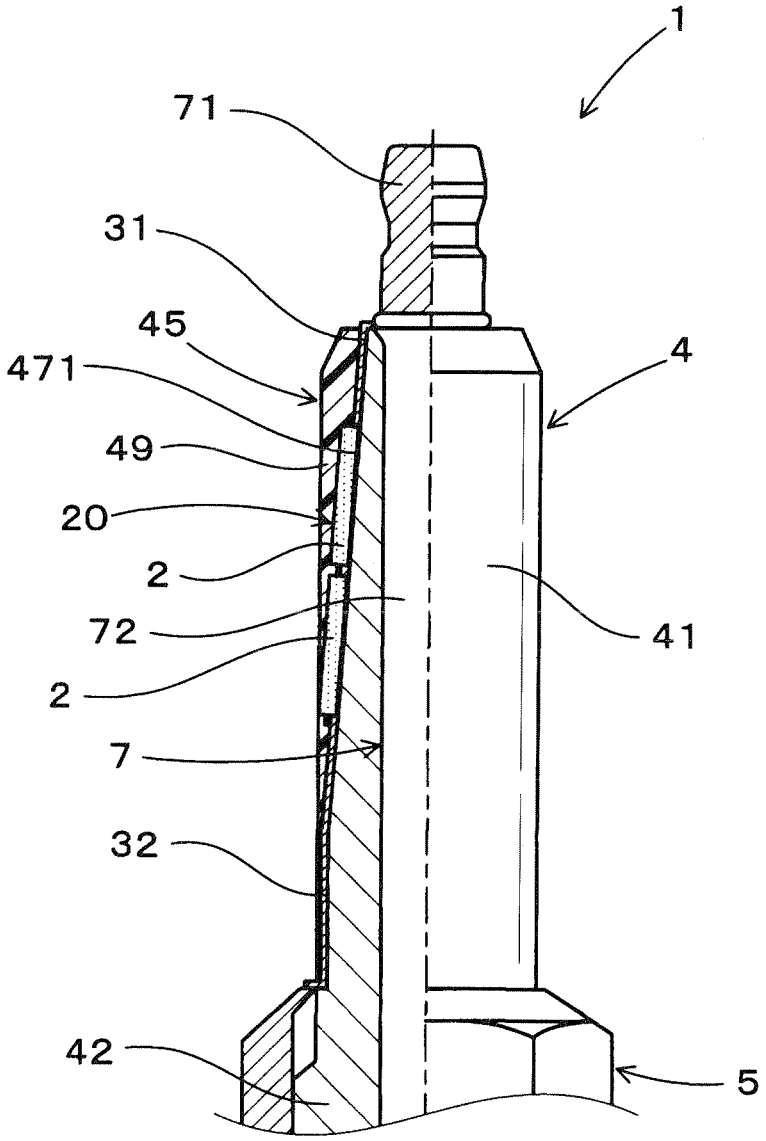
FIG. 9 is a partially cross-sectional view of part of a spark plug according to a third embodiment.
Figure 10:
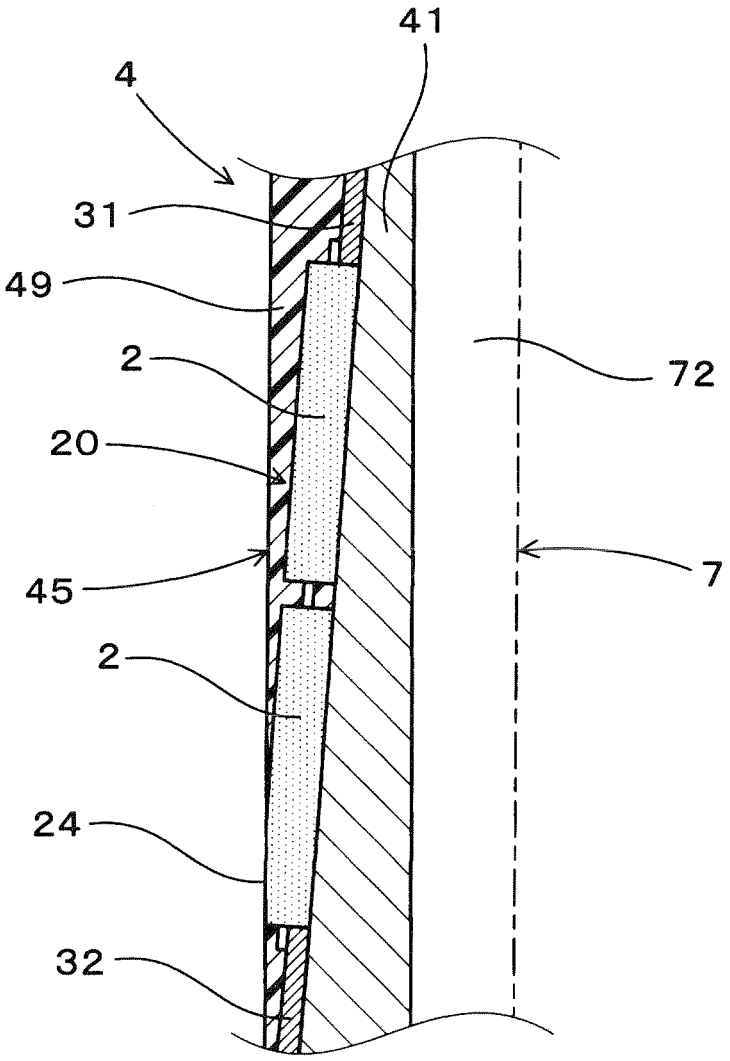
FIG. 10 is an enlarged view of part of FIG. 9.

In comparison, in the present embodiment, as shown in FIGS. 9 and 10, the groove 45 is formed in the radially outer surface of the cylindrical portion 41 of the insulator 4 so that: the entire bottom surface of the first connecting terminal-receiving part 481, the entire bottom surface 471 of the element-receiving part 47 and part of the bottom surface of the second connecting terminal-receiving part 482 extend obliquely with respect to the axial direction of the cylindrical portion 41; and the remainder of the bottom surface of the second connecting terminal-receiving part 482 extends in the axial direction of the cylindrical portion 41.

More specifically, in the present embodiment, the bottom surface 471 of the element-receiving part 47 of the groove 45 extends obliquely with respect to the axial direction of the cylindrical portion 41 so that the distance between the bottom surface 471 and the radially outer surface of the cylindrical portion 41 gradually decreases in the distalward direction. Consequently, the distance between the pair of voltage-constant elements 2, which is arranged on the bottom surface 471 of the element-receiving part 47 of the groove 45, and the main body 72 of the stem 7 which is inserted and held in the insulator 4 gradually increases in the distalward direction.

Moreover, as shown in FIG. 10, the distal-side voltage-constant element 2 has a bevel 24 formed at its distal and radially outer corner. The bevel 24 is shaped so as to have the outer surface of a resin mold of the distal-side voltage-constant element 2 conforming to the radially outer surface of the cylindrical portion 41 of the insulator 4.

The above-described spark plug 1 according to the present embodiment has almost the same advantages as the spark plug 1 according to the first embodiment.

In addition, in the present embodiment, the pair of voltage-constant elements 2 is arranged in the insulator 4 such that the distance between the pair of voltage-constant elements 2 and the main body 72 of the stem 7 increases in the distalward direction (i.e., in the axial direction of the insulator 4 toward the spark gap 10).

With the above arrangement, it is possible to secure a sufficient distance between the second connecting terminal 32 and the stem 7. Consequently, it is possible to secure a sufficient thickness of the insulator 4 between the second connecting terminal 32 and the stem 7, thereby reliably preventing puncture (or breakdown) of the insulator 4 from occurring between the second connecting terminal 32 and the stem 7.

[Fourth Embodiment]

This embodiment illustrates a spark plug 1 which has almost the same structure as the spark plug 1 according to the first embodiment; accordingly, only the differences therebetween will be described hereinafter.

In the first embodiment, the element-receiving part 47 of the groove 45 of the insulator 4 has the bottom surface 471 and the pair of side surfaces 472. Each of the side surfaces 472 extends perpendicular to the bottom surface 471 so that the interior angle formed between the bottom surface 471 and the side surface 472 is equal to 90° (see FIG. 2).

Figure 11:
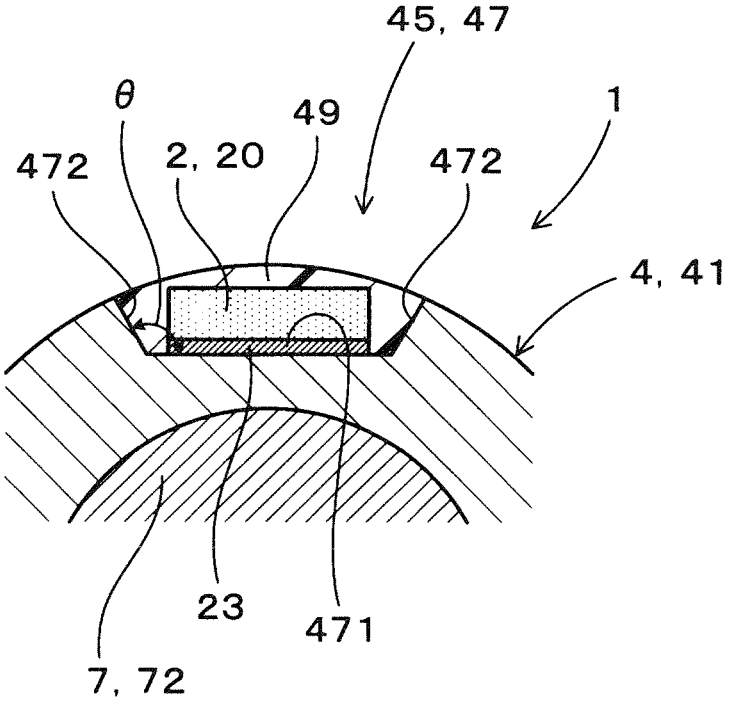
FIG. 11 is a cross-sectional view of part of a spark plug according to a fourth embodiment.

In comparison, in the present embodiment, as shown in FIG. 11, each of the side surfaces 472 extends obliquely with respect to the bottom surface 471 so that the interior angle formed between the bottom surface 471 and the side surface 472 is equal to 120°.

Moreover, in the present embodiment, each of the voltage-constant elements 2 is configured to include a main body 21 and a base plate 23. The main body 21 is formed by resin-molding a Zener diode element. The base plate 23 is made of an aluminum alloy and has the main body 21 mounted thereon. Each of the voltage-constant elements 2 is arranged in the element-receiving part 47 of the groove 45 of the insulator 4 such that the base plate 23 of the voltage-constant element 2 abuts the bottom surface 471 of the element-receiving part 47.

In addition, it should be appreciated that the base plates 23 of the voltage-constant elements 2 may also be made of other metal materials which are easily available and preferably have a heat conductivity in the range of 5 to 450 W/mK. Those metal materials include, for example, copper, carbon steel and aluminum. In this case, it is possible to secure a high heat dissipation performance of the base plate 23.

The above-described spark plug 1 according to the present embodiment has almost the same advantages as the spark plug 1 according to the first embodiment.

Moreover, in the present embodiment, each of the voltage-constant elements 2 is configured to include the main body 21 and the base plate 23 that has the main body 21 mounted thereon. The base plate 23 is made of the aluminum alloy and arranged so as to abut the insulator 4.

Consequently, heat generated by the voltage-constant elements 2 during operation can be effectively transmitted to the insulator 4 via the base plates 23 of the voltage-constant elements 2.

Further, in the present embodiment, the groove 45 of the insulator 4 has the bottom surface 471 and the pair of side surfaces 472. The bottom surface 471 is recessed radially inward from the radially outer surface of the insulator 4 and extends perpendicular to a radial direction of the insulator 4. The side surfaces 472 extend respectively from opposite circumferential ends of the bottom surface 471 to the radially outer surface of the insulator 4. The pair of voltage-constant elements 2 is arranged on the bottom surface 471 of the groove 45. Each of the side surfaces 472 of the groove 45 makes with the bottom surface 471 an interior angle in the range of 90 to 120°, more particularly equal to 120° in the present embodiment.

With the above configuration, it is possible to effectively and stably dissipate the heat generated by the voltage-constant elements 2 during operation.

While the above particular embodiments have been shown and described, it will be understood by those skilled in the art that various modifications, changes, and improvements may be made without departing from the spirit of the present invention.

For example, in the previous embodiments, the overvoltage preventer 20 is made up of the pair of voltage-constant elements 2. However, it is also possible to make up the overvoltage preventer 20 with a single voltage-constant element or three or more voltage-constant elements.

Moreover, in the previous embodiments, each of the voltage-constant elements 2 is implemented by the Zener diode. However, each of the voltage-constant elements 2 may also be alternatively implemented by, for example, an avalanche diode or a varistor.

In the previous embodiments, the ground electrode 51 has no discharge chip provided therein. However, it is also possible to provide a discharge chip on the end part of the second portion 512 of the ground electrode 51 so as to axially face the discharge chip 62 of the center electrode 6 through the spark gap 10 formed therebetween.

What is claimed is:

1. A spark plug for an internal combustion engine, the spark plug comprising:

a center electrode;

a tubular insulator having the center electrode inserted and held therein;

a tubular metal shell having the insulator inserted and held therein such that a proximal part of the insulator is exposed from the metal shell;

a ground electrode that is joined to a distal end of the metal shell and faces the center electrode through a spark gap formed between the center and ground electrodes; and an overvoltage preventer that prevents a voltage higher than or equal to a threshold voltage from being applied across the spark gap; wherein:

the overvoltage preventer is arranged in the proximal part of the insulator so as to be positioned outside the metal shell and farther than the metal shell from the spark gap;

the overvoltage preventer is made up of at least one voltage-constant element which is electrically connected in parallel with a spark-discharge path that includes the center electrode, the ground electrode and the spark gap formed between the center and ground electrodes;

the spark plug further comprises a stem that is electrically connected with the center electrode;

the stem has a main body inserted and held in the insulator and a terminal that is positioned on a proximal side of the main body and protrudes from a proximal end of the insulator;

the at least one voltage-constant element is electrically connected with the stem by a first connecting terminal and with the meal shell by a second connecting terminal;

the insulator has a groove formed in a radially outer surface of the insulator so as to extend in axial direction of the insulator, and the at least one voltage-constant element and the first and second connecting terminals are received in the groove of the insulator so as to be positioned radially inward of the radially outer surface of the insulator.

2. The spark plug as set forth in claim 1, wherein the groove has an element-receiving part for receiving the at least one voltage-constant element, a first connecting terminal-receiving part for receiving the first connecting terminal and a second connecting terminal-receiving part for receiving the second connecting terminal, and at least one of the first and second connecting terminal-receiving parts has a smaller cross-sectional area perpendicular to the axial direction of the insulator than the element-receiving part.

3. The spark plug as set forth in claim 1, wherein a thickness of the insulator between the second connecting terminal and the main body of the stem is set to be greater than or equal to 1 mm.

4. The spark plug as set forth in claim 1, wherein the at least one voltage-constant element is arranged in the insulator such that the distance between the at least one voltage-constant element and the main body of the stem increases in an axial direction of the insulator toward the spark gap.

5. The spark plug as set forth in claim 1, wherein on a cross section of the second connecting terminal perpendicular to an axial direction of the insulator, a thickness of the second connecting terminal in a radial direction of the insulator is less than a width of the second connecting terminal in a direction perpendicular to the radial direction.

6. The spark plug as set forth in claim 1, wherein a filler member is filled in a space formed between the at least one voltage-constant element and the insulator, and the filler member has a higher heat conductivity than air.

7. The spark plug as set forth in claim 1, wherein the at least one voltage-constant element is configured to include a main body and a base plate that has the main body mounted thereon, and the base pate is made of a metal material and arranged so as to abut the insulator.

8. The spark plug as set forth in claim 1, wherein the groove has a bottom surface and a pair of side surfaces, the bottom surface being recessed radially inward from the radially outer surface of the insulator and extends perpendicular to a radial direction of the insulator, the side surfaces extending respectively from opposite circumferential ends of the bottom surface to the radially outer surface of the insulator, the at least one voltage-constant element is arranged on the bottom surface of the groove, and each of the side surfaces of the groove makes an interior angle in a range of 90 to 120° with the bottom surface.

9. A spark plug for an internal combustion engine, the spark plug comprising:

a center electrode;

a tubular insulator having the center electrode inserted and held therein;

a tubular metal shell having the insulator inserted and held therein such that a proximal part of the insulator is exposed from the metal shell;

a ground electrode that is joined to a distal end of the metal shell and faces the center electrode through a spark gap formed between the center and ground electrodes; and an overvoltage preventer that prevents a voltage higher than or equal to a threshold voltage from being applied across the spark gap, wherein:

the overvoltage preventer is arranged in the proximal part of the insulator so as to be positioned outside the metal shell and farther than the metal shell from the spark gap;

the overvoltage preventer is made up of at least one voltage-constant element which is electrically connected in parallel with a spark-discharge path that includes the center electrode, the ground electrode and the spark gap formed between the center and ground electrodes;

the spark plug further comprises a stem that is electrically connected with the center electrode;

the stem has a main body inserted and held in the insulator and a terminal that is positioned on a proximal side of the main body and protrudes from a proximal end of the insulator;

the at least one voltage-constant element is electrically connected with the stem by a first connecting terminal and with the meal shell by a second connecting terminal;

the insulator has both a first hole and a second hole formed therein, the first hole extending in an axial direction of the insulator, the second hole extending so as to communicate with the first hole and open on a radially outer surface of the insulator at a position adjacent to the metal shell;

the first connecting terminal, the at least one voltage-constant element and part of the second connecting terminal are received in the first hole, and the remainder of the second connecting terminal is received in the second hole.

* * * * *